United States Patent [19]

Reynard

[11] Patent Number: 4,728,234

[45] Date of Patent: Mar. 1, 1988

[54] MEANS FOR SECURING TOGETHER FREIGHT CONTAINERS

[75] Inventor: Kenneth Reynard, Thirsk, England

[73] Assignee: George Blair Public Limited Company, Newcastle upon Tyne, England

[21] Appl. No.: 928,267

[22] Filed: Nov. 6, 1986

[30] Foreign Application Priority Data

Nov. 13, 1985 [GB] United Kingdom ..... 8528027

[51] Int. Cl.[4] ..... B65D 90/00

[52] U.S. Cl. ..... 410/82; 24/287; 220/23.4

[58] Field of Search ..... 24/287, 453, 590, 591, 24/593; 206/509; 220/23.2, 23.4; 410/77, 82; 411/349, 549, 553, 352, 84, 85; 403/348, 349

[56] References Cited

U.S. PATENT DOCUMENTS

| | | | |
|---|---|---|---|
| 3,220,078 | 11/1965 | Preziosi | 411/349 |
| 3,370,873 | 2/1968 | Holton | 24/590 X |
| 3,954,344 | 5/1976 | Nakama | 403/348 X |
| 3,972,439 | 8/1976 | DiMartino | 24/287 |
| 4,049,149 | 9/1977 | Dorenec | 24/287 X |
| 4,196,673 | 4/1980 | Looks | 24/287 X |

*Primary Examiner*—David A. Scherbel
*Assistant Examiner*—Scott H. Werny
*Attorney, Agent, or Firm*—Abelman Frayne Rezac & Schwab

[57] ABSTRACT

Members are provided for securing together a pair of freight containers having corner fittings which abut one another, the abutting walls of the corner fittings each having formed therein aligned, elongate apertures. The members comprise an elongate locking member in the opposed sidewalls of which are formed opposed grooves each of generally tapering configuration. On passage of the locking member through the aligned apertures to bring the grooves into axial alignment with the abutting walls, and on subsequent rotation of the locking member about its central longitudinal axis, the edge regions of the walls bounding the apertures are received within the grooves to be urged into locking engagement with one another by the sidewalls of the grooves.

3 Claims, 4 Drawing Figures

MEANS FOR SECURING TOGETHER FREIGHT CONTAINERS

BACKGROUND OF THE INVENTION

This invention relates to means for securing freight containers together and more particularly to such means for co-operating with the corner fittings of standard containers.

Freight containers are produced in a series of standard sizes and are known as I.S.O. containers. These containers are provided with corner fittings each of which comprises a hollow, generally box-shaped component provided with apertures in some of the faces thereof for receiving therein releasable securing means. Hereinafter any reference to 'corner fitting' is to be understood as referring to a corner fitting of the above described type.

It is conventional practice to transport large numbers of such containers on board ships with adjacent containers interconnected with one another to form a block of containers.

The current system for interconnecting adjacent containers is to utilize a pair of releasable securing means, commonly known as twistlocks, one located in one corner fitting of one container and the other located in the adjacent corner fitting of the other container. The two twistlocks are themselves interconnected by a screw-threaded bolt and associated nuts, which are screwed up to effect the necessary connection.

Such an arrangement has a number of disadvantages. The two twistlocks, together with the interconnecting bolt and nuts, are expensive to produce and are prone to corrosion, particularly at the nuts. Further, the twistlocks project outwardly from the end faces of the containers, while the screw-threaded bolts and nuts are located externally of the containers whereby said components are prone to damage and adjacent rows of containers must be spaced from one another to accommodate the connecting means.

SUMMARY OF THE INVENTION

It is an object of the present invention to provide cheaper means for securing together containers and which enable a more compact block of containers to be formed with adjacent rows capable of abutting one another.

According to the present invention there is provided means for securing together a pair of freight containers each provided with corner fittings of the type described, the containers including a pair of abutting corner fittings the abutting walls of which each have formed therein aligned, elongate apertures, the means comprising an elongate locking member the opposed sidewalls of which have formed therein opposed grooves each of generally tapering configuration, the arrangement being such that, on passage of the locking member through the apertures in the abutting walls to bring the grooves into axial alignment with said walls, and on rotation of the locking member about its central longitudinal axis, the edge regions of said walls bounding the apertures are received within, to be urged into locking engagement with one another by the sidewalls of, said grooves.

Preferably the locking member is of generally rectangular shape in transverse section, the length of the major transverse axis being less than the length of the major axis of said apertures but greater than the length of the minor axis of said apertures, whereby the locking member can be passed through the aligned apertures with the major axes of the locking member and the apertures aligned, rotation of the locking member through 90° about its central longitudinal axis bringing the opposed grooves, one at each end of the major axis of the transverse section of the locking member, into a position embracing said edge regions of the walls of the corner fittings bounding said apertures.

The width of the grooves, considered in the longitudinal direction of the locking member, tapers inwardly of the locking member from the top to the bottom of the grooves to define a configuration capable of effecting the locking together of two I.S.O. containers and corner fittings incorporating manufacturing tolerances up to the maximum permissible values—with arrangements incorporating maximum tolerances, locking engagement of the walls of the apertures with the grooves is effected in the upper, wider regions of the grooves, while, with the components at minimum tolerance, said engagement is effected nearer the bases of the grooves.

Conveniently, an end region of the locking member includes means facilitating rotation thereof, for example an aperture through which can be passed a bar or like elongate member.

DESCRIPTION OF THE PREFERRED EMBODIMENT

Figure 4:
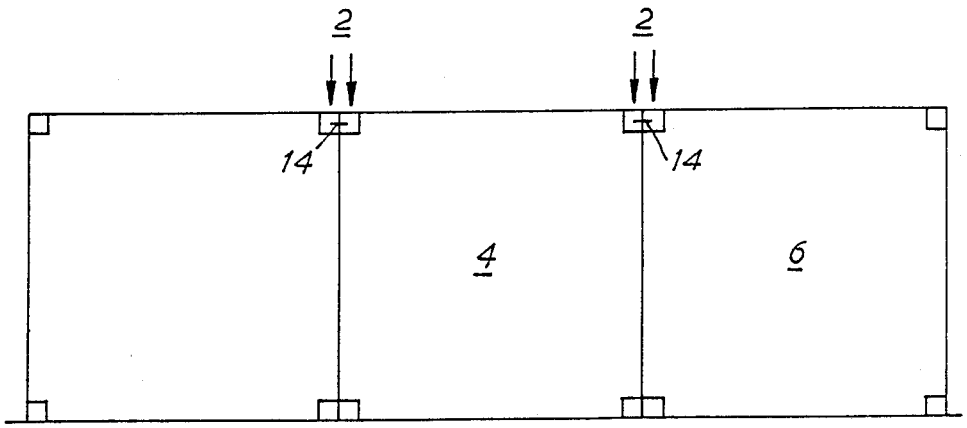
FIG. 4 is a schematic end view of three containers secured together by means according to the invention.

Referring to the drawings, there are shown two conventional corner fittings each indicated generally at 2, one located at the corner of each of two abutting I.S.O. freight containers such as 4,6 in FIG. 4. Each corner fitting comprises a hollow steel casting of predetermined dimensions and provided with conventionally-shaped apertures in some of the walls thereof, including an aperture 8 in the top wall and an aperture 10 in the sidewall 12 abutting the other fitting.

The means for securing together the two adjacent corner fittings 2 comprises a locking member indicated generally at 14. Said member 14 comprises an elongate metal key of generally rectangular shape in transverse section, the width $W_1$ of the key being less than the height H of the apertures 10 but greater than the width $W_2$ of said apertures.

A pair of opposed grooves 16 are formed in opposite sidewalls of the key 14 whereby the distance D between the bases of the two grooves is less than the width $W_2$ of the apertures 10. The opposed sidewalls of each groove 16 each include an outer extent perpendicular to the longitudinal axis of the key 14 and an inwardly tapering extent terminating in the base of the associated groove.

The precise dimensions of the grooves 16 are very carefully chosen and are closely determined by the maximum and minimum tolerances permissible in manufacture of the corner fittings and the containers.

More particularly the width of the outer region of each groove 16 is such as to be able to receive therein the abutting portions 18 of the sidewalls 12 defining the apertures 10 even when the corner fittings and the containers are manufactured at maximum permissible tolerance, while the tapering nature of the inner region of each groove 16 is such that the width at the base of the groove is just less than the width of the abutting portions 18 of the sidewalls 12 when every component is on minimum tolerance.

Figure 2:
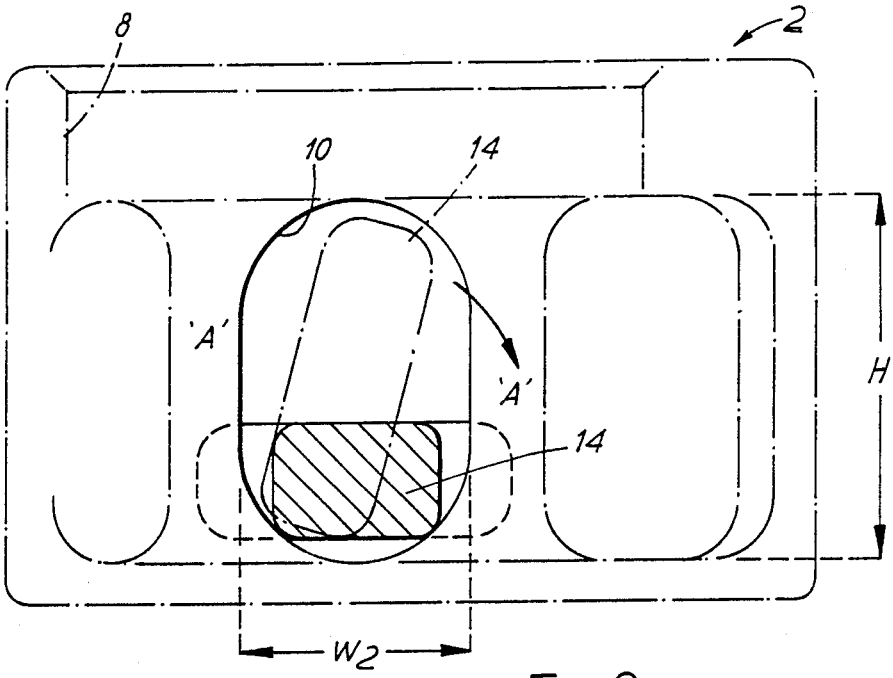
FIG. 2 is a section on the line II—II of FIG. 1.

In use of the key 14 to secure together two abutting containers 4,6, the key is inserted through the aperture 8 into the hollow interior of one of the corner fittings 2, and is then passed through the aligned apertures 10 with the width $W_1$ of the key extending substantially parallel with the height H of the apertures 10 as shown in dotted lines in FIG. 2.

When the key 14 is in a position such that the grooves 16 are aligned with the abutting sidewalls 12 of the corner fitting, the key 14 is rotated through 90° about its central longitudinal axis, as indicated by the arrows 'A' in FIG. 2, towards the position shown in full lines in the drawings with the edge regions of the portions 18 of the sidewalls 12 received within the grooves 16.

Figure 1:
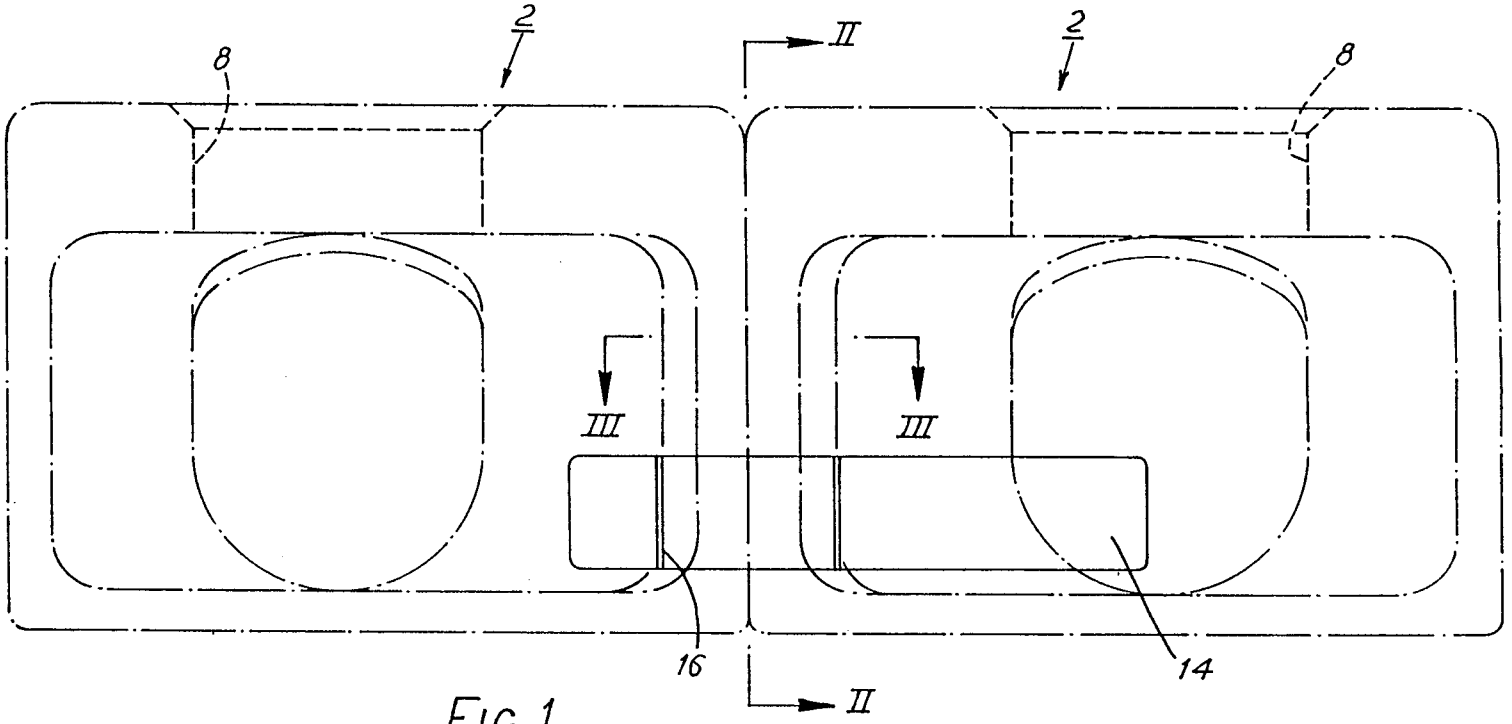
FIG. 1 is an end view of two corner fittings secured together by means according to the invention.
Figure 3:
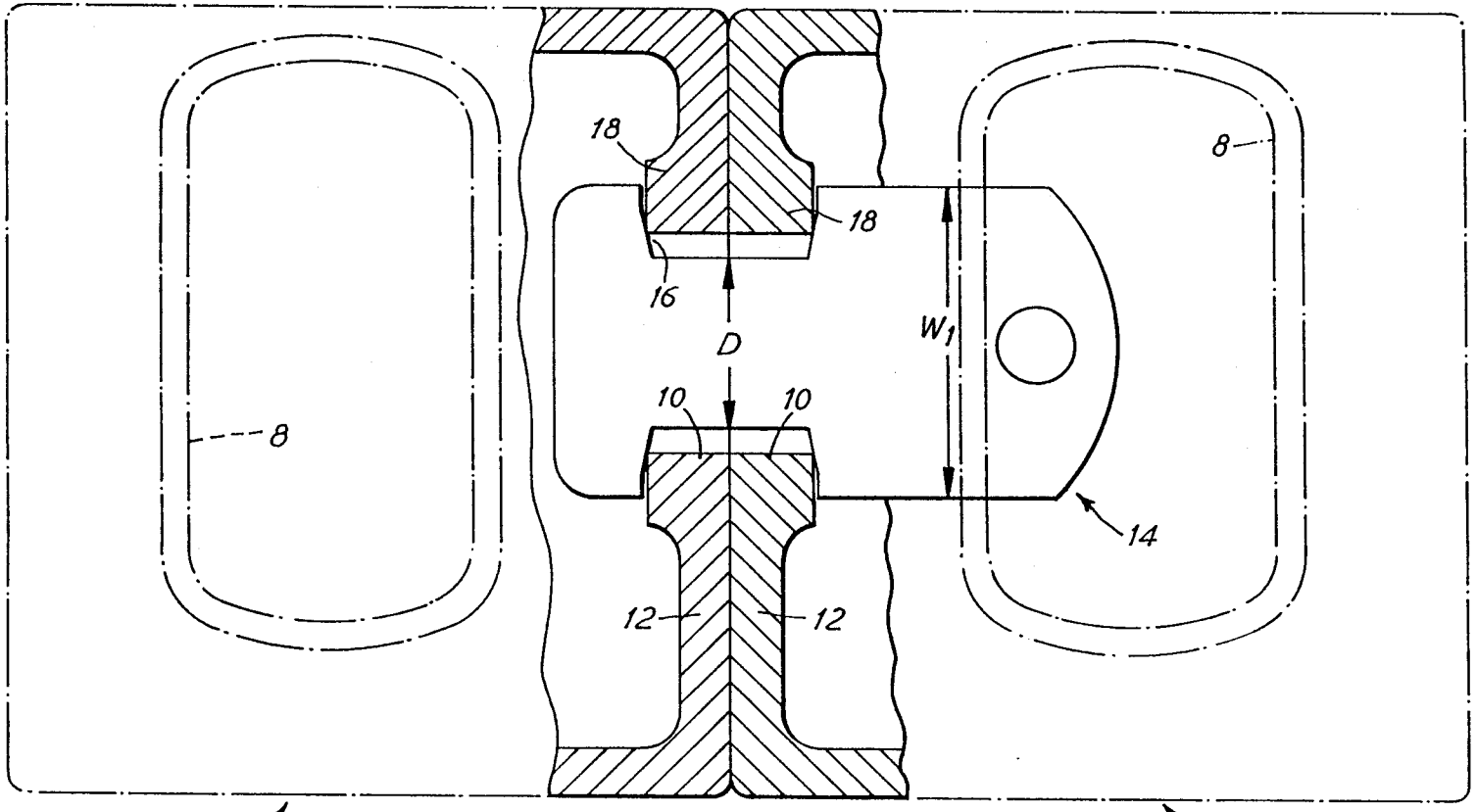
FIG. 3 is a part section on the line III—III of FIG. 1.

FIGS. 1 to 3 show corner fittings manufactured with minimum tolerances, the locking position of the key 14 being at the lower end of the slightly-rounded apertures 10 with the edge regions of the portions 18 of sidewalls 12 being in locking engagement with the tapering inner extents of the grooves 16.

A key 14 securing together components manufactured at maximum permissible tolerances would adopt a locking position intermediate the height H of the apertures 10 and with the edge regions of the portions 18 of the sidewalls 12 co-operating with the parallel outer extents of the grooves 16.

The end region of the key 14 is conveniently provided with an aperture 20 through which can be passed a bar or like elongate member to facilitate rotation of the key 14 from the position shown in dotted lines in FIG. 2 to the locking position.

It will be appreciated that the described means for securing together two abutting corner fittings, and therefore two abutting freight containers, is simple and cheap to manufacture and is housed completely within the fittings being interconnected. Thus there are no maintenance or corrosion problems and it is possible for adjacent rows of interconnected containers to abut one another and comprise a solid block of containers with no gaps therebetween.

What I claim and desire to secure by Letters Patent is:

1. Means for securing together a pair of freight containers each provided with corner fittings of the type described, the containers including a pair of abutting corner fittings the abutting walls of which each have formed therein aligned, elongate apertures, the securing means comprising an elongate locking member of generally rectangular shape in transverse section, the length of the major transverse axis being less than the length of the major axis of said apertures but greater than the length of the minor axis of said apertures, the locking member having opposed sidewalls, said sidewalls defining therein opposed grooves, one to each end of the major axis of the transverse section of the locking member, the widths of the grooves considered in the longitudinal direction of the locking member tapering inwardly of the locking member from the top to the bottom of the grooves, the arrangement being such that, on passage of the locking member through the apertures in the abutting walls with the major axes of the locking member and the apertures aligned to being the grooves into axial alignment with said walls, and on rotation of the locking member through 90° about its central longitudinal axis, the edge regions of said walls bounding the apertures are received within, to be urged into locking engagement with one another by the sidewalls of, said grooves.

2. Means as claimed in claim 1 in which the opposed sidewalls of the grooves include outermost parallel extents perpendicular to the longitudinal axis of the locking member and inwardly tapering extents terminating in the base of the associated groove.

3. Means as claimed in claim 1 in which an end region of the locking member defines therein an aperture through which can be passed an elongate member to facilitate rotation of the locking member.

* * * * *